US006439801B1

(12) United States Patent
Galiana et al.

(10) Patent No.: US 6,439,801 B1
(45) Date of Patent: Aug. 27, 2002

(54) PROTECTIVE OR DELIMITING BARRIER HAVING A FLEXIBLE CONNECTING SYSTEM

(75) Inventors: Raphaël Galiana, F-13830 Roquefort la Bedoule; Jean-Louis Hellio, La Ciotat, both of (FR)

(73) Assignee: Raphael Galiana, Roquefort la Bedoule (FR)

( * ) Notice: Subject to any disclaimer, the term of this patent is extended or adjusted under 35 U.S.C. 154(b) by 0 days.

(21) Appl. No.: 09/684,969

(22) Filed: Oct. 10, 2000

Related U.S. Application Data

(63) Continuation of application No. PCT/FR99/00827, filed on Apr. 9, 1999.

(30) Foreign Application Priority Data

Apr. 10, 1998 (FR) ..... 98 4781

(51) Int. Cl.[7] ..... E01F 15/00
(52) U.S. Cl. ..... 404/6; 404/7; 256/1; 256/13.1
(58) Field of Search ..... 404/6, 7, 9, 12; 256/13.1, 1

(56) References Cited

U.S. PATENT DOCUMENTS

| | | | | |
|---|---|---|---|---|
| 4,288,061 A | | 9/1981 | Moreau | |
| 5,104,255 A | * | 4/1992 | Bodensohn | 404/7 |
| 5,137,391 A | * | 8/1992 | Ballesteros | 404/6 |
| 5,531,540 A | * | 7/1996 | Wasserstrom et al. | 404/6 |
| 5,605,413 A | | 2/1997 | Brown | |
| 5,685,665 A | | 11/1997 | Lembo | |
| 5,836,714 A | * | 11/1998 | Christensen | 404/6 |

FOREIGN PATENT DOCUMENTS

| | | |
|---|---|---|
| FR | 2314303 | 1/1977 |
| FR | 2439269 | * 10/1978 |
| FR | 2425503 | 12/1979 |
| FR | 2585047 | 1/1987 |
| FR | 2598484 | 11/1987 |
| FR | 305624 | 3/1989 |
| WO | 442249 | 8/1991 |
| WO | 97/09485 | 3/1997 |

* cited by examiner

*Primary Examiner*—David Bagnell
*Assistant Examiner*—Sunil Singh

(57) ABSTRACT

Protective or delimiting barrier for road traffic includes a plurality of hollow separating elements. Each of the separating elements includes a cylindro-convex end and a cylindro-concave end. Each of the separating elements is capable of containing a shock absorbing volume of air. A lower flexible member is provided and is one of a strap and a band. The lower flexible member extends through at least one separating element and into an adjacent separating element. An upper flexible member is provided and is one of a strap and a band. The upper flexible member extends through at least one separating element and into an adjacent separating element. The upper flexible member is arranged above the lower flexible member. The plurality of separating elements are connected end-to-end such that the cylindro-convex end of one separating element is disposed adjacent the cylindro-concave end of another separating element. An articulation is formed between the cylindro-convex end of one separating element and the cylindro-concave end of an adjacent separating element.

19 Claims, 3 Drawing Sheets

PROTECTIVE OR DELIMITING BARRIER HAVING A FLEXIBLE CONNECTING SYSTEM

CROSS-REFERENCE TO RELATED APPLICATIONS

This is a continuation of International Application No. PCT/FR99/00827 filed on Apr. 9, 1999, not published under PCT Article 21(2) in English, the disclosure of which is hereby incorporated by reference thereto in its entirety and the priority of which is hereby claimed under 35 U.S.C. 120. The present application also claims priority under 35 U.S.C. §119 of French Patent Application No. 98 04781 filed on Apr. 10, 1998.

BACKGROUND OF THE INVENTION

1. Field of the Invention

The present invention relates to a protective barrier obtained by way of the juxtaposition and the articulated end-to-end connection of a plurality of separating elements.

2. Description of Background and Relevant Information

A particularly advantageous, albeit non-exclusive example of application of the barriers according to the invention is in the equipment of karting or motorcycle racetracks, or automobile speedways, for ensuring the safety of the competitors and spectators. Another interesting application is the delimiting or the separation of the road or highway traffic, parking areas, quays, airport runways, etc.

A separating or delimiting barrier for road traffic has been proposed in U.S. Pat. No. 5,605,413. The barrier comprises a plurality of separating elements formed of a hollow and empty body, having an oblong horizontal section. The elements are capable of containing a shock-absorbing volume of air and are connected end-to-end and linked to one another by way of two superposed flexible links that extend through them by passing through two superposed passages provided at each of the ends of the elements.

The flexible links are constituted by cables that are connected by shackles. The cables of a separating element are linked to the cables of a neighboring element by way of shackles hidden in the spacing between these elements. These cables can constitute dangerous sharp elements when a vehicle violently strikes the barrier and causes the fracture of a separating element, or when a vehicle strikes the barrier in the spacing between the two elements.

The separating barrier described in document FR 2 598 482 A is embodied in a similar manner and has the same disadvantages, with the added disadvantage that the separating elements are made of reinforced concrete and thus constitute themselves a source of danger for the vehicles that strike them. According to this document, each of the separating elements comprises a cylindro-convex end and a cylindro-concave end, the separating elements being connected and interlocked end-to-end by their cylindro-convex end and their cylindro-concave end which form an articulated interlocking or cylindrical articulation with the cylindro-concave end and with the cylindro-convex end, respectively, of neighboring separators.

A safety barrier is described in document FR A 2 425 503, which is constituted of a plurality of cylindrical modules arranged after one another and at a distance from one another, and linked by steel cables or ropes. These modules include a cylindrical, flexible armature formed by a stack of used tires covered by an outer coating and filled by a material such as cement, plaster or mortar (FR A 2 314 303, constituting the module itself) and cast within said armature. This barrier provides mediocre shock absorbing qualities, although they are better than those obtained with the barrier described in document FR A 2 598 484. Conversely, the use of steel cables or ropes to connect the modules to one another causes a serious danger for the occupants of the vehicles that strike these cables, the danger being increased by the spacing provided between the modules.

In view of their disadvantages outlined hereinabove, the barriers embodied according to the prior art documents are to be forbidden in certain applications, such as karting or motorcycle racetracks, or the like.

SUMMARY OF THE INVENTION

The invention overcomes the aforementioned disadvantage of the separating or delimiting barriers, resulting from the fact that the separating elements are connected to one another by one or more cables.

The person with ordinary skill in the art knows that a flexible strap or band can be used to link the separating elements of a protective or delimiting barrier for road traffic, as shown in the document WO 97/09485. However, according to this document, this barrier comprises either a single woven strap in transverse passages of the separating elements, or a series of looped straps each surrounding the ends of two separating elements connected end-to-end.

This mode of linking the separating elements does not make it possible to overcome the aforementioned disadvantages of the protective barriers described in documents U.S. Pat. No. 5,605,413 A, FR 2 598 484 A, and FR A 2 425 503.

The protective or delimiting barrier for road traffic described herein overcomes these disadvantages.

An important advantage of this barrier resides in the fact that the flexible and large links connecting the separating elements do not present any danger for the drivers of the vehicles that strike the barrier. Indeed, these flexible and large links act like crash barriers should the separating elements be spaced apart or smashed in, and they are themselves provided with a natural elasticity contributing to absorbing the impacts.

According to another aspect of the invention, there is provided a protective or delimiting barrier for road traffic comprising a plurality of hollow separating elements, each of the separating elements comprising a cylindro-convex end and a cylindro-concave end, each of the separating elements being capable of containing a shock absorbing volume of air, a lower flexible member being one of a strap and a band, and extending through at least one separating element and into an adjacent separating element, an upper flexible member being one of a strap and a band, and extending through at least one separating element and into an adjacent separating element, whereby the upper flexible member is arranged above the lower flexible member, and the plurality of separating elements being connected end-to-end such that the cylindro-convex end of one separating element is disposed adjacent the cylindro-concave end of another separating element, wherein an articulation is formed between the cylindro-convex end of one separating element and the cylindro-concave end of an adjacent separating element.

At least one of the upper and lower flexible members may comprise synthetic fibers or textiles. The upper and lower flexible members may be one of arranged vertically one above the other and arranged one above the other on a substantially vertical plane. Each separating element may have a shape of an oblong horizontal section. At least one of the upper and the lower flexible members may comprise a width on the order of 50 mm. The cylindro-convex end and the cylindro-concave end of at least one separating element may comprise a diameter which is equal to a width of the at least one separating element. At least one of the separating elements may have a length L which is at least two times greater than a width I of the at least one separating element. The length may be two and a half times greater than the width of the at least one separating element. At least one of the separating elements may have a length L which is on the order of 100 cm, a width I which is on the order of 40 cm, and a height H which is on the order of 50 cm. At least one of the upper and the lower flexible members may be a continuous flexible member which extends through each of the separating elements in the plurality of separating elements.

The invention also provides for a protective or delimiting barrier for road traffic comprising a plurality of hollow separating elements, each of the separating elements comprising a cylindro-convex end and a cylindro-concave end. Each cylindro-convex end comprises at least one through opening, each cylindro-concave end comprises at least one through opening, the plurality of separating elements being arranged end-to-end such that the cylindro-convex end of one separating element is disposed adjacent the cylindro-concave end of another separating element. The at least one opening of the cylindro-convex end of one separating element is aligned with the at least one opening of the cylindro-concave end of an adjacent separating element, and at least one flexible member connecting at least one separating element with an adjacent separating element, whereby the at least one flexible member passes through the at least one opening of the cylindro-convex end and through the at least one opening of the cylindro-concave end, to form an articulation between the cylindro-convex end of one separating element and the cylindro-concave end of another separating element.

The at least one opening may comprise two openings and the at least one flexible member may comprise two flexible members. The at least one flexible member may comprise synthetic fibers or textiles. Each separating element may have a shape of an oblong horizontal section and wherein the at least one flexible member comprises a width on the order of 50 mm . The cylindro-convex end and the cylindro-concave end of at least one separating element may comprise a diameter which is equal to a width of the at least one separating element. At least one of the separating elements may have a length L which is at least two times greater than a width I of the at least one separating element. The at least one flexible member may be a continuous flexible member which extends through each of the separating elements in the plurality.

The invention further provides for a protective or delimiting barrier for road traffic comprising a plurality of hollow separating elements, each of the separating elements comprising a cylindro-convex end and a cylindro-concave end. Each cylindro-convex end comprises two through openings, each cylindro-concave end comprises two through openings. The plurality of separating elements are arranged end-to-end such that the cylindro-convex end of one separating element is disposed adjacent the cylindro-concave end of an adjacent separating element, whereby the two openings of the cylindro-convex end of one separating element are aligned with the two openings of the cylindro-concave end of an adjacent separating element, and two continuous flexible members connecting each of the separating elements in the plurality, whereby the two flexible members pass through each of the separating elements in the plurality, wherein an articulation is formed between each of the separating elements in the plurality.

The two openings and the two flexible members may be arranged one above the other and on a substantially vertical plane. Each separating element may comprise the same width and the cylindro-convex end and the cylindro-concave end of each separating element may comprise a diameter which is equal to a width of the separating elements.

BRIEF DESCRIPTION OF DRAWINGS

The aforementioned characteristics and advantages, and still others, will become more apparent from the description that follows and the annexed drawings, in which.

DETAILED DESCRIPTION OF THE INVENTION

Figure 1:
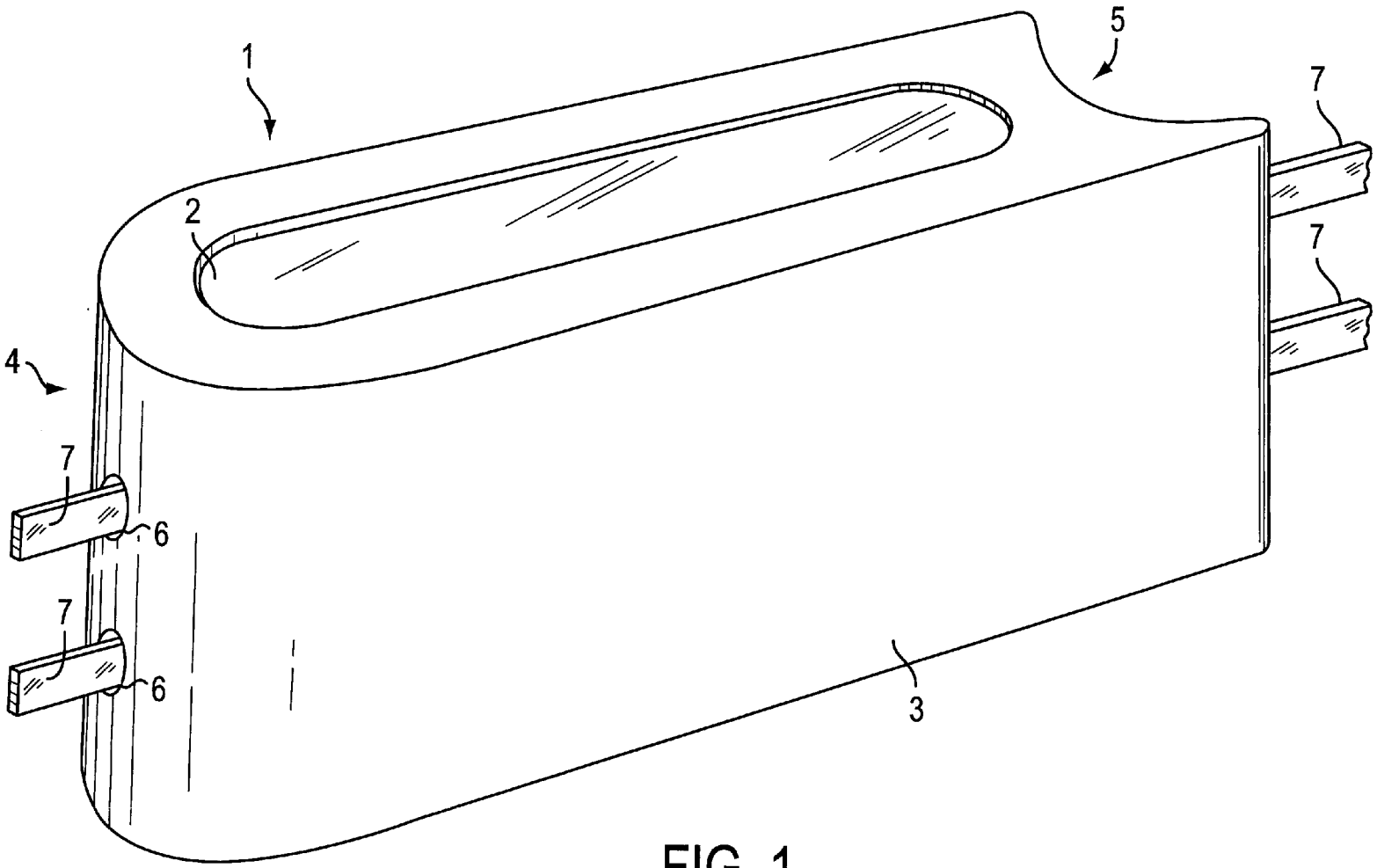
FIG. 1 is a perspective view of a separating element that can be used for obtaining a protective or delimiting barrier for road traffic according to the invention.
Figure 3:
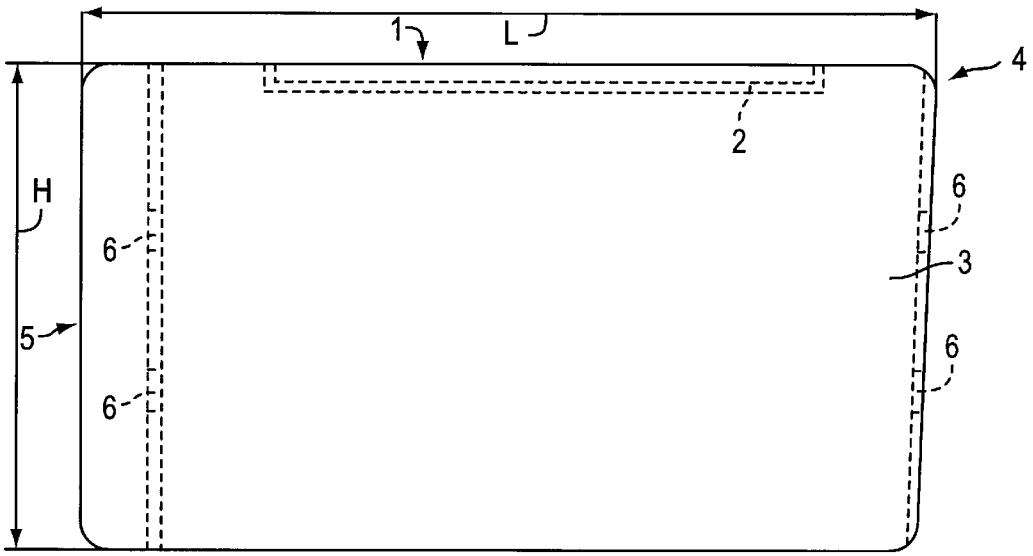
FIG. 3 is a side view thereof.
Figure 2:
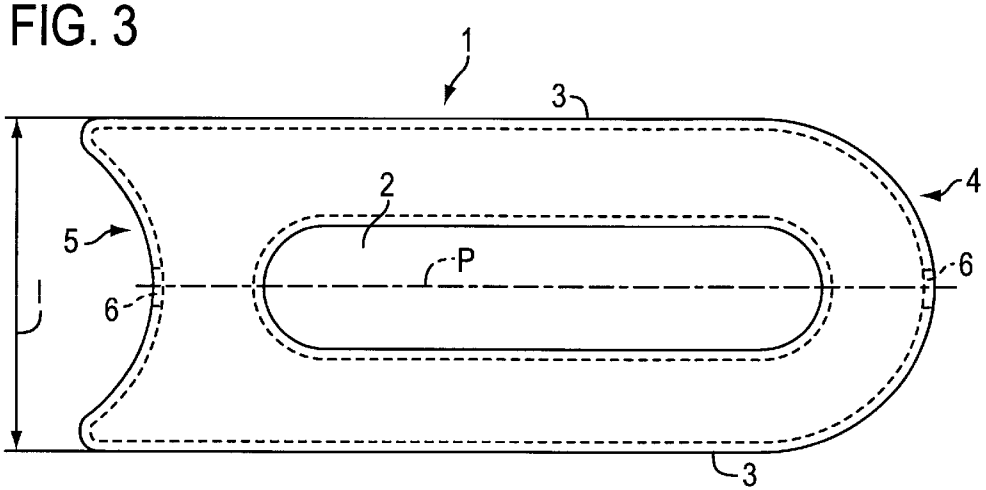
FIG. 2 is a planar view of this separating element.
Figure 4:
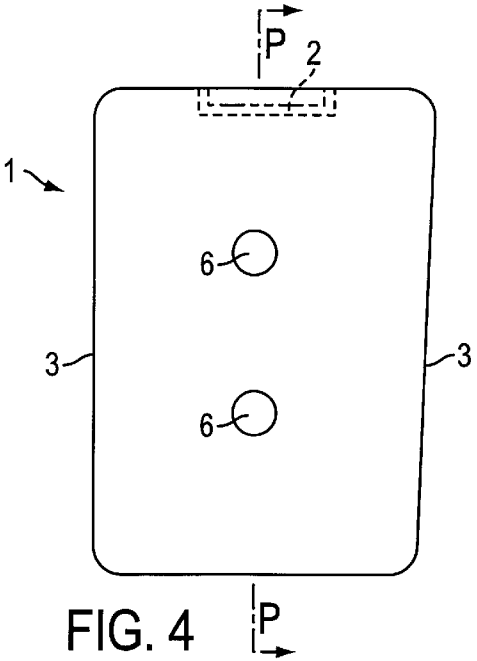
FIG. 4 is a front view of one of the ends of this separating element.

One refers to the drawings to describe an advantageous, although in no way limiting, example of embodiment of a protective or delimiting barrier obtained according to the invention, and of a type of separating element that can be used advantageously to obtain this barrier.

This separating element 1 is, for example, made of a plastic material such as a thermoplastic polymer, for example, high density polyethylene, by implementing a rotational molding technique, or rotomolding, so as to have both the desired rigidity and a good resistance to impact.

This separator is in the form of a hollow, homogenous, and empty body comprising an oblong horizontal section. Advantageously, its upper and lower bases comprise a large, oblong central rib 2 so as to reinforce its rigidity and resistance to impacts. The air cushion confined within this body and the relative flexibility of its lateral walls constitute an efficient device for absorbing impacts.

According to another characteristic arrangement, the separator 1 according to the invention has a length L that is at least two times greater than its width I and, for example, a length two and a half times greater than its width, or $L=1\times2.5$.

This separator has, for example, a length L on the order of 100 cm, a width I on the order of 40 cm, and a height H on the order of 50 cm.

In particular, these dimensions have the advantages of enabling an easy manipulation of the separating elements by the fitters due to their reduced weight, of providing a relatively large lateral surface for retaining vehicles, the creation of a voluminous air cushion constituting an efficient shock absorber, and the creation of an adequate distance between their lateral walls contributing to the resistance to staving in.

The separator comprises a cylindro-convex end 4 and a cylindro-concave end 5 having an identical radius, connected by two planar and parallel lateral portions 3. The diameter of the cylinders defined by the ends 4 and 5 of the separating elements corresponds to the width of the latter.

In this way, it is possible to interlock a plurality of identical or similar separators 1A, 10 1B, 1C, 1D, . . . , 1N end-to-end to constitute a protective or delimiting barrier, the cylindro-convex end 4 and cylindro-concave end 5 of each intermediate separator thus forming an articulated interlocking or a cylindrical articulation with the cylindro-concave end and with the cylindro-convex end, respectively, of the two identical or similar separators between which it is positioned.

Advantageously, each convex end 4 or concave end 5 of the separating elements 1 thus configured comprises at least two superposed openings or passages 6 with horizontal axes separated, for example, by a distance on the order of 20 cm, and arranged in the vertical median plane P—P of the separator. These superposed passages 6 allow, therethrough the separator, the passage of two superposed flexible links 7 making it possible to connect it to a set of identical or similar separators interlocked end-to-end for obtaining a protective or delimiting barrier for road traffic according to the invention.

The upper and lower longitudinal passages 6 can be arranged at equal distance from the upper and lower surfaces, respectively, of the separator that is thus reversible.

According to an important characteristic arrangement of the invention, the flexible links 7 used for connecting the separating elements are constituted by flat straps or bands preferably made of synthetic fibers or textiles such as, for example, polyamides, polyesters, or the like. Such flat bands, similar to lifting straps, can advantageously have a width on the order of 50 mm.

These flat bands, provided with a certain stretching capacity under a substantial tensile force, are arranged one above the other, such that their width is positioned in a vertical, or substantially vertical plane, as shown in FIG. 1.

It is understood that when a vehicle strikes a separator 1, there occurs, in addition to a sliding of the latter on the ground, a compression of the air cushion contained in the separator 1 which thus fulfills the role of a shock absorber, the fracture of the separator struck being avoided by the provision of the openings 6 for the passage of the straps 7 allowing the air to escape.

As indicated previously, the flat straps act like crash barriers in the case where the separating elements are spaced apart or smashed in.

Figure 5:
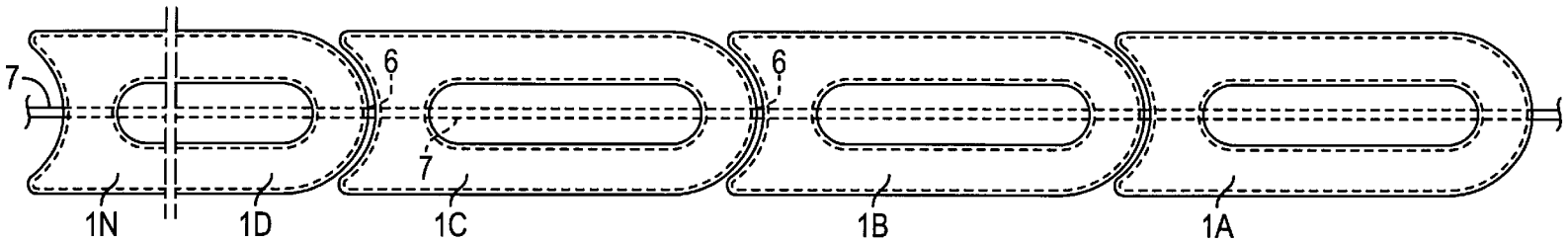
FIG. 5 is a planar view showing a rectilinear barrier obtained by the connection, according to the invention, of separators arranged end-to-end.
Figure 6:
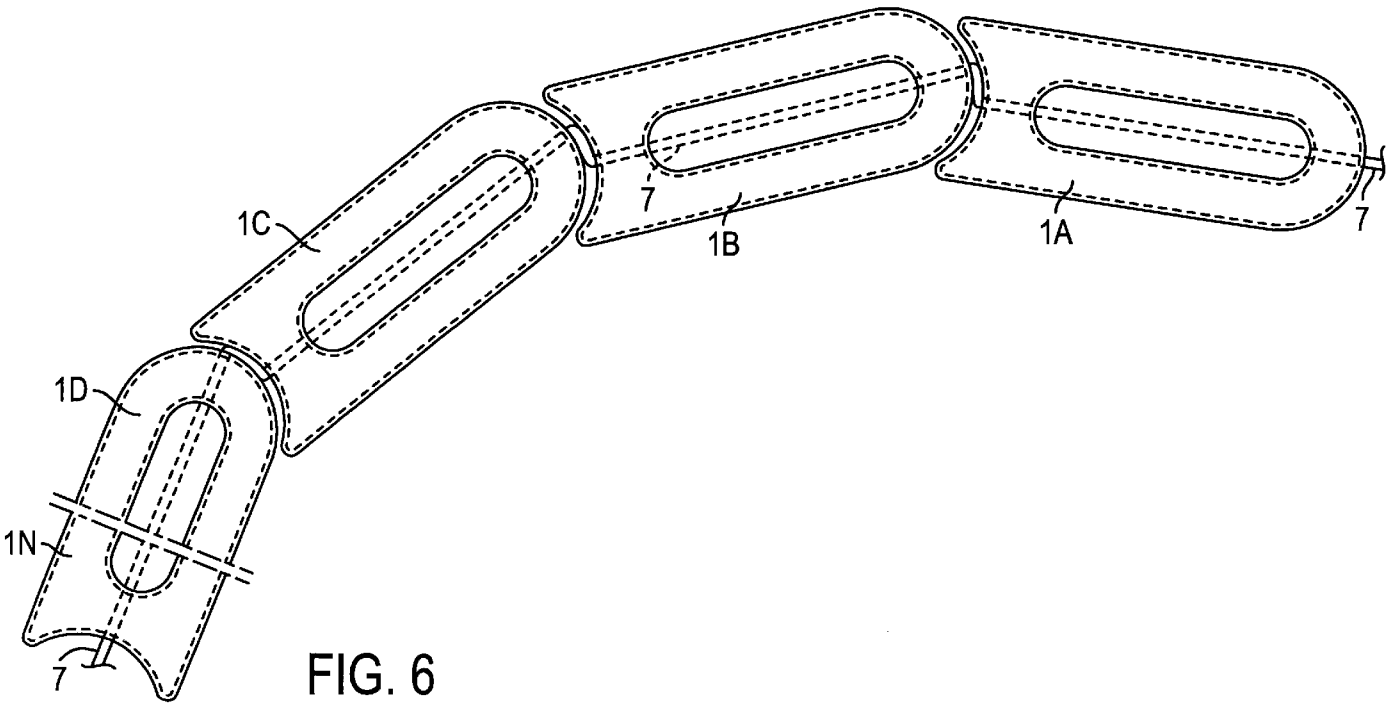
FIG. 6 is a top view showing a curved barrier embodied by way of separators connected according to the invention.

It is also understood that to obtain a protective barrier, it suffices to connect and interlock end-to-end a plurality of separators 1, and to link the latter by flexible straps 7 extending through their superposed passages 6 (FIG. 5). The ends of these straps can be fixed to stationary members anchored in the ground, or to elastic or non-elastic abutting members taking support against the end surfaces of the terminal elements 1A, 1N in the series of separators.

Due to the joining of the separating elements 1 by way of a cylindrical articulation, or knuckle joint, the latter can have varied slopes with respect to one another, such that it is possible to quickly assemble rectilinear or curved protective barriers having more or less short radii, depending on the layout of the racetracks or racing circuits.

What is claimed is:

1. A protective or delimiting barrier for road traffic comprising:

a plurality of hollow separating elements;

each of the separating elements comprising a cylindro-convex end and a cylindro-concave end;

each of the separating elements being capable of containing a shock absorbing volume of air;

a lower flexible member being one of a strap and a band, and extending through at least one separating element and into an adjacent separating element;

an upper flexible member being one of a strap and a band, and extending through at least one separating element and into an adjacent separating element, whereby the upper flexible member is arranged above the lower flexible member; and the plurality of separating elements being connected end-to-end such that the cylindro-convex end of one separating element is disposed adjacent the cylindro-concave end of another separating element, wherein an articulation is formed between the cylindro-convex end of one separating element and the cylindro-concave end of an adjacent separating element.

2. The barrier of claim 1, wherein at least one of the upper and lower flexible members comprises synthetic fibers or textiles.

3. The barrier of claim 1, wherein the upper and lower flexible members are one of arranged vertically one above the other and arranged one above the other on a substantially vertical plane.

4. The barrier of claim 1, wherein each separating element has the shape of an oblong horizontal section.

5. The barrier of claim 1, wherein at least one of the upper and the lower flexible members comprises a width on the order of 50 mm.

6. The barrier of claim 1, wherein the cylindro-convex end and the cylindro-concave end of at least one separating element comprises a diameter which is equal to a width of the at least one separating element.

7. The barrier of claim 1, wherein at least one of the separating elements has a length L which is at least two times greater than a width I of the at least one separating element.

8. The barrier of claim 7, wherein the length is two and a half times greater than the width of the at least one separating element.

9. The barrier of claim 1, wherein at least one of the separating elements has a length L which is on the order of 100 cm, a width I which is on the order of 40 cm, and a height H which is on the order of 50 cm.

10. The barrier of claim 1, wherein at least one of the upper and the lower flexible members is a continuous flexible member which extends through each of the separating elements in the plurality of separating elements.

11. A protective or delimiting barrier for road traffic comprising:

a plurality of hollow separating elements;

each of the separating elements comprising a cylindro-convex end and a cylindro-concave end;

each cylindro-convex end comprising two through openings;

each cylindro-concave end comprising two through openings;

the plurality of separating elements being arranged end-to-end such that the cylindro-convex end of one separating element is disposed adjacent the cylindro-concave end of another separating element, whereby the two through openings of the cylindro-convex end of one separating element are aligned with the two through openings of the cylindro-concave end of an adjacent separating element; and two flexible members connecting at least one separating element with an adjacent separating element, whereby the two flexible members pass through the two through openings of the cylindro-convex end of the at least one separating element and through the two through openings of the cylindro-concave end of the ad;-cent separating element, wherein an articulation is formed between the cylindro-convex end of one separating element and the cylindro-concave end of another separating element.

12. The barrier of claim 11, wherein the two flexible members comprise synthetic fibers or textiles.

13. The barrier of claim 11, wherein each separating element has the shape of an oblong horizontal section and wherein the two flexible members comprise a width on the order of 50 mm.

14. The barrier of claim 11, wherein the cylindro-convex end and the cylindro-concave end of at least one separating element comprises a diameter which is equal to a width of the at least one separating element.

15. The barrier of claim 11, wherein at least one of the separating elements has a length L which is at least two times greater than a width I of the at least one separating element.

16. The barrier of claim 11, wherein the two flexible members are continuous and extend through each of the separating elements in the plurality.

17. A protective or delimiting barrier for road traffic comprising:

a plurality of hollow separating elements;

each of the separating elements comprising a cylindro-convex end and a cylindro-concave end;

each cylindro-convex end comprising two through openings;

each cylindro-concave end comprising two through openings;

the plurality of separating elements being arranged end-to-end such that the cylindro-convex end of one separating element is disposed adjacent the cylindro-concave end of an adjacent separating element, whereby the two openings of the cylindro-convex end of one separating element are aligned with the two openings of the cylindro-concave end of an adjacent separating element; and two continuous flexible members connecting each of the separating elements in the plurality, whereby the two flexible members pass through each of the separating elements in the plurality;

wherein an articulation is formed between each of the separating elements in the plurality.

18. The barrier of claim 17, wherein the two openings and the two flexible members are arranged one above the other and on a substantially vertical plane.

19. The barrier of claim 17, wherein each separating element comprises the same width and wherein the cylindro-convex end and the cylindro-concave end of each separating element comprises a diameter which is equal to a width of the separating elements.

* * * * *